US007347515B1

(12) United States Patent
Lu

(10) Patent No.: US 7,347,515 B1
(45) Date of Patent: Mar. 25, 2008

(54) SLIDING RAIL ASSEMBLY AUTO OPENING MECHANISM FOR DRAWER

(75) Inventor: Chun-Min Lu, Taipei Hsien (TW)

(73) Assignee: Gslide Corporation, Taipei Hsien (TW)

( * ) Notice: Subject to any disclaimer, the term of this patent is extended or adjusted under 35 U.S.C. 154(b) by 458 days.

(21) Appl. No.: 11/171,337

(22) Filed: Jul. 1, 2005

(51) Int. Cl.
*A47B 88/04* (2006.01)

(52) U.S. Cl. ..... 312/333; 312/319.1

(58) Field of Classification Search ..... 312/330.1, 312/333, 319.1, 334.1, 334.7, 334.8, 334.44, 312/334.46, 334.47; 384/21, 22
See application file for complete search history.

(56) References Cited

U.S. PATENT DOCUMENTS 5,207,781 A * 5/1993 Rock ..... 312/319.1
6,672,692 B2 * 1/2004 Weng ..... 312/333
6,799,817 B1 * 10/2004 Chu ..... 312/333
6,979,066 B2 * 12/2005 Yang ..... 312/333
7,077,487 B2 * 7/2006 Yang ..... 312/333
7,159,958 B1 * 1/2007 Lu ..... 312/334.44
7,244,005 B1 * 7/2007 Lu ..... 312/333
2002/0033658 A1 * 3/2002 Salice ..... 312/334.14
2005/0093406 A1 * 5/2005 Yang ..... 312/333

* cited by examiner

*Primary Examiner*—James O. Hansen
(74) *Attorney, Agent, or Firm*—Troxell Law Office, PLLC

(57) ABSTRACT

A sliding rail assembly auto opening mechanism for drawer is disclosed to include a holder block affixed to the outer rail of a sliding rail assembly and defining two longitudinal sliding slots, a sliding hook slidably mounted in the longitudinal sliding slots, a spring member connected between the holder block and the sliding hook, and a rocker, which is pivoted to a pivot in the holder block and has a front locating rod insertable through guide-in groove, sliding groove, retaining groove and guide-out groove at the holder block to automatically lock the sliding rail assembly when the sliding rail assembly is received with the drawer in the desk and to automatically unlock the sliding rail assembly when the drawer is pushed backwards from the locking position over a predetermined distance.

5 Claims, 23 Drawing Sheets

SLIDING RAIL ASSEMBLY AUTO OPENING MECHANISM FOR DRAWER

BACKGROUND AND SUMMARY OF THE INVENTION

The present invention relates to a sliding rail assembly for drawer and more specifically, to an auto opening mechanism used in a sliding rail assembly for drawer, which saves much installation space, can easily be operated to unlock the sliding rail assembly, and prevents a false action when a child touches the drawer accidentally.

A conventional auto opening mechanism for drawer is installed in the back panel of the desk. When the user imparted a pressure to the face panel of the drawer to force the drawer against the auto opening mechanism, the auto opening mechanism automatically ejects the drawer out of the desk. This design of auto opening mechanism is still not satisfactory in function because of the following drawbacks.

1. Because the auto opening mechanism is installed in the back panel of the desk and aimed at the longitudinal central axis of the drawer, the user must push the center part of the face panel of the drawer when wishing to open the drawer. If the user pushes one lateral side of the face panel of the drawer backwards, the auto opening mechanism will not be actuated.
2. The auto opening mechanism occupies much inside space of the desk, thereby reducing the available inside space of the desk for the drawer.
3. When a child touches the face panel of the drawer accidentally, the auto opening mechanism may be actuated to eject the drawer out of the desk, and the ejecting drawer may hurt the child.

Therefore, it is desirable to provide a sliding rail assembly auto opening mechanism that eliminates the aforesaid drawbacks.

The present invention has been accomplished under the circumstances in view. According to one aspect of the present invention, the sliding rail assembly auto opening mechanism is comprised of a holder block, a sliding hook a spring member, a rocker, and an actuating member. The holder block is affixed to the outer rail of the sliding rail assembly inside the desk, having two parallel sliding slots for guiding movement of the sliding hook. The actuating member is affixed to the inner sliding rail at the drawer, and works with the spring member to control the action of the sliding hook. The rocker is pivoted to a pivot in the holder block, having a front locating rod movable in and out of the guide-in groove, retaining groove, sliding groove and guide-out groove of the holder block. By means of the aforesaid arrangement, the drawer can be automatically opened when pressed, and then returned to the locked status when received in the desk.

According to another aspect of the present invention, a distance between the retaining portion of the retaining groove and the front side of the sliding groove ensures that the drawer can be unlocked and opened only when the sliding hook has been moved forwards over such a distance to have the front locating rod of the sliding hook be moved away from the retaining portion through the sliding groove into the guide-out groove. Therefore, the user must push the drawer backwards over such a distance to unlock the sliding rail assembly. This design prevents a false action of the sliding rail assembly when a child touches the drawer accidentally.

According to still another aspect of the present invention, the sliding rail assembly auto opening mechanism does not occupy an additional inside space of the desk because the parts of the sliding rail assembly auto opening mechanism are mounted in the sliding rail assembly. Therefore, the invention saves much installation space.

According to still another aspect of the present invention, the sliding rail assembly auto opening mechanism is provided between one side panel of the drawer and an inside wall of the desk, and the sliding rail assembly is automatically opened (unlocked) when the face panel of the drawer is moved inwards over a predetermined distance.

DETAILED DESCRIPTION OF THE INVENTION

Figure 1:
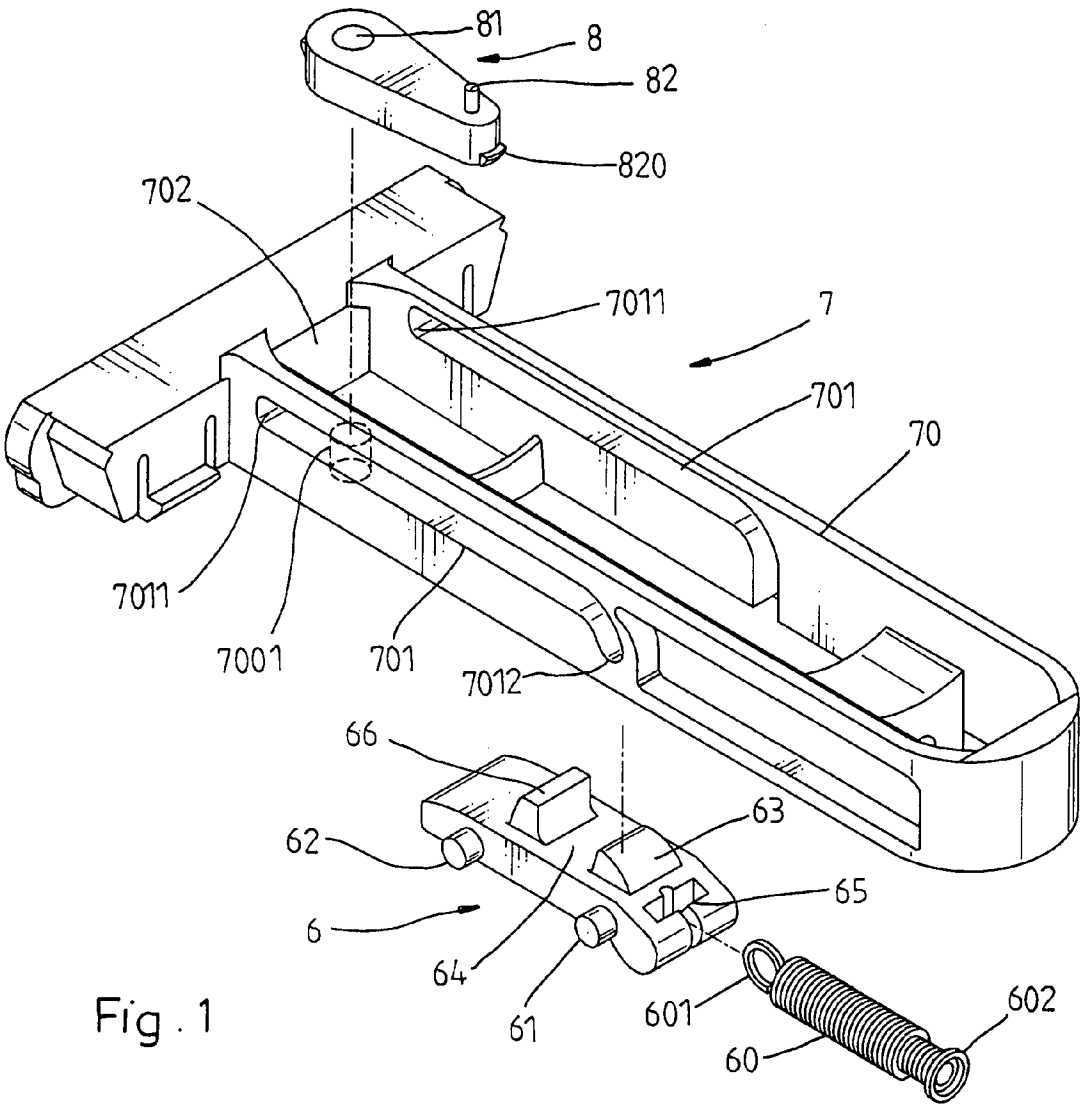
FIG. 1 is an exploded view of a sliding rail assembly auto opening mechanism according to the present invention (the actuating member excluded).
Figure 2:
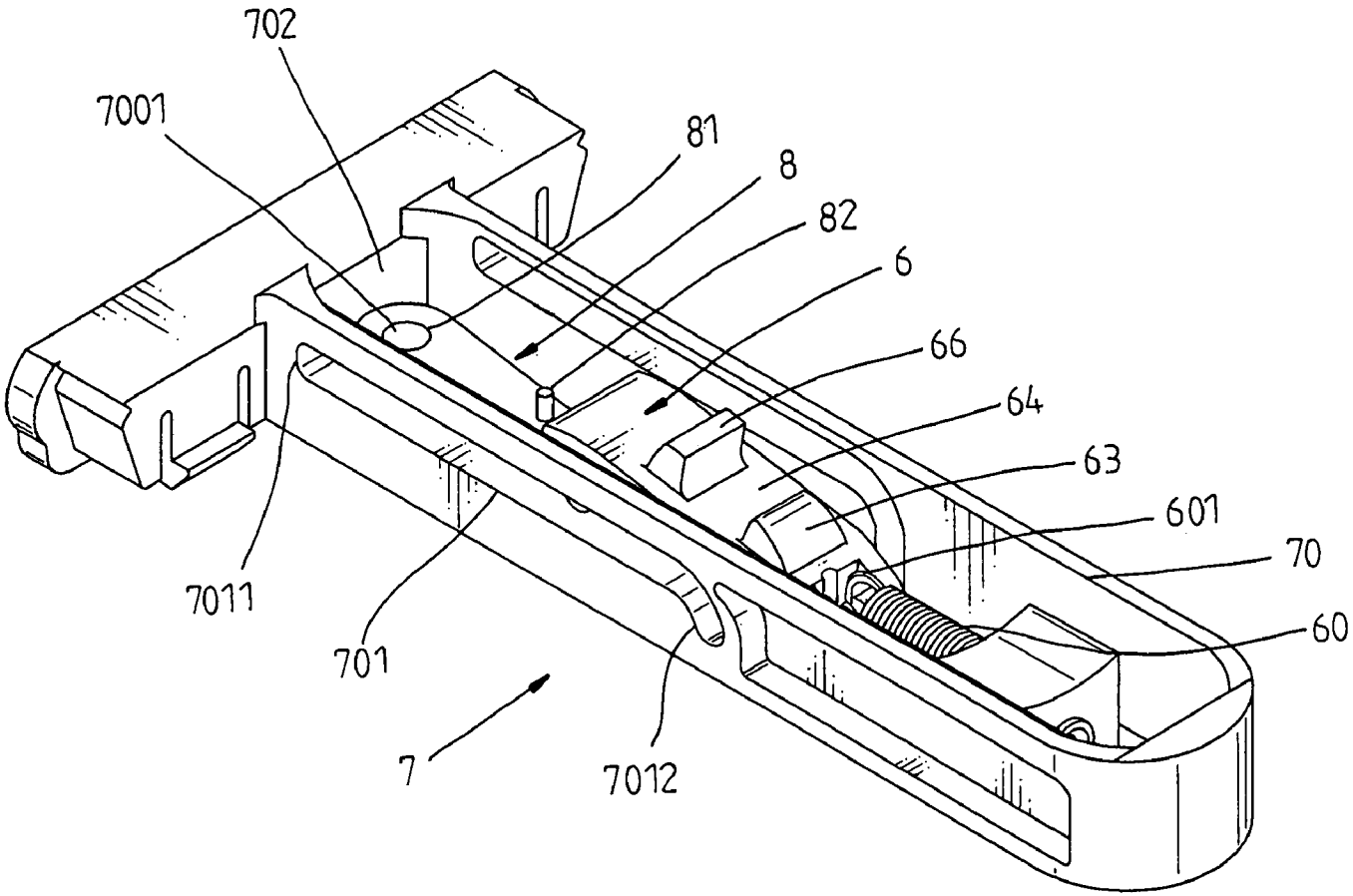
FIG. 2 is an elevational assembly view of FIG. 1.
Figure 3:
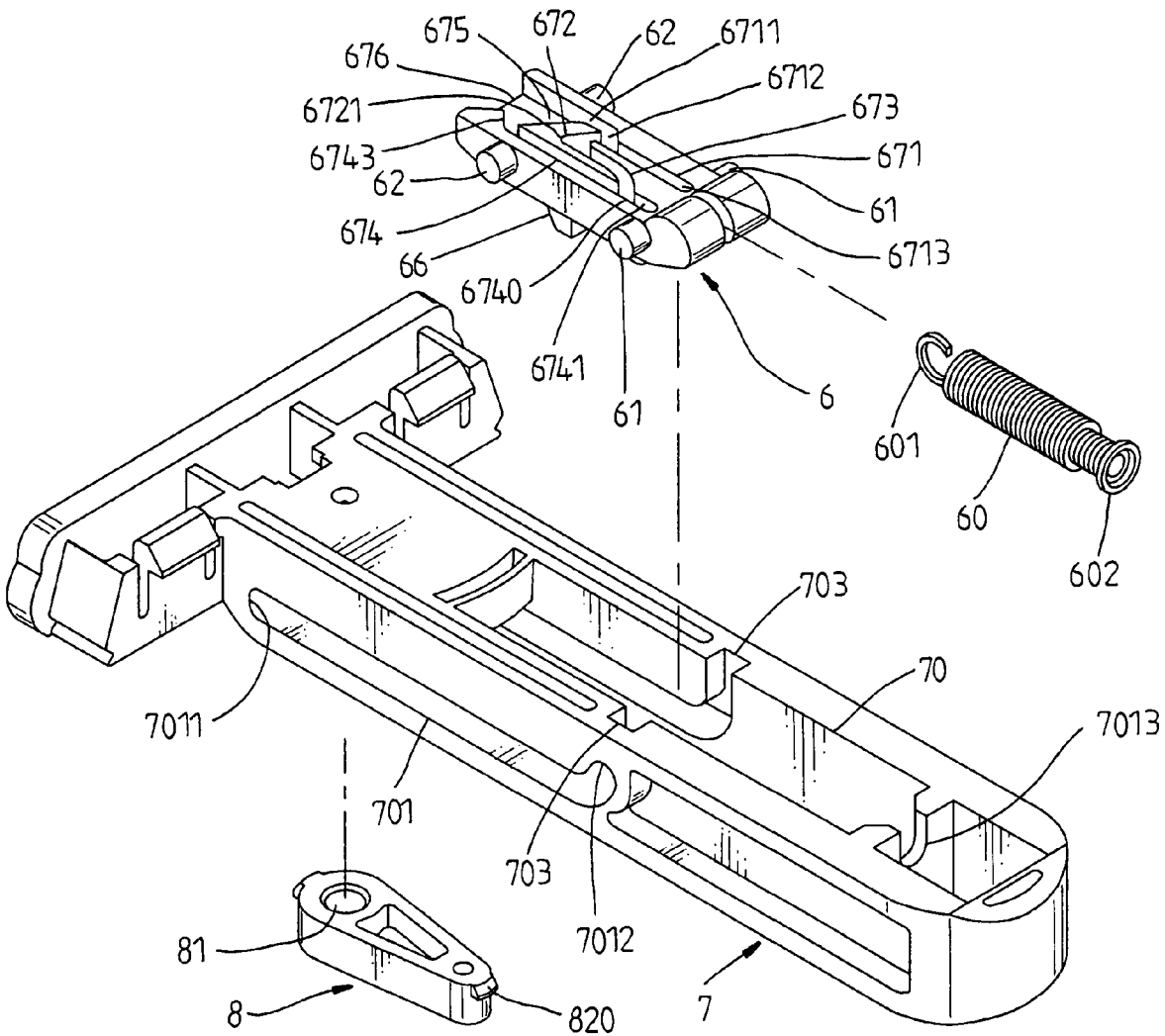
FIG. 3 corresponds to FIG. 1 when viewed from another angle.
Figure 4:
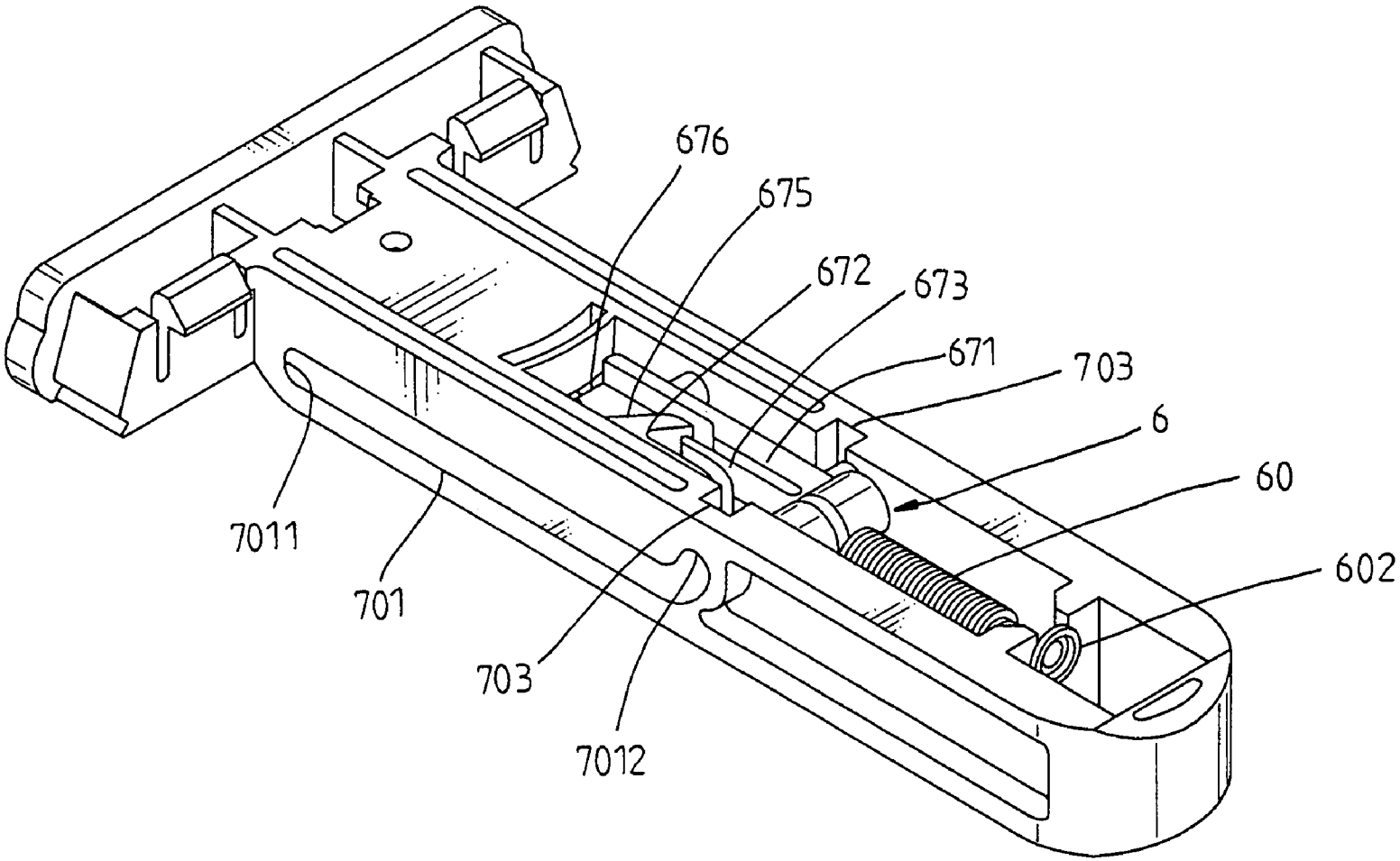
FIG. 4 corresponds to FIG. 2 when viewed from another angle.
Figure 5:
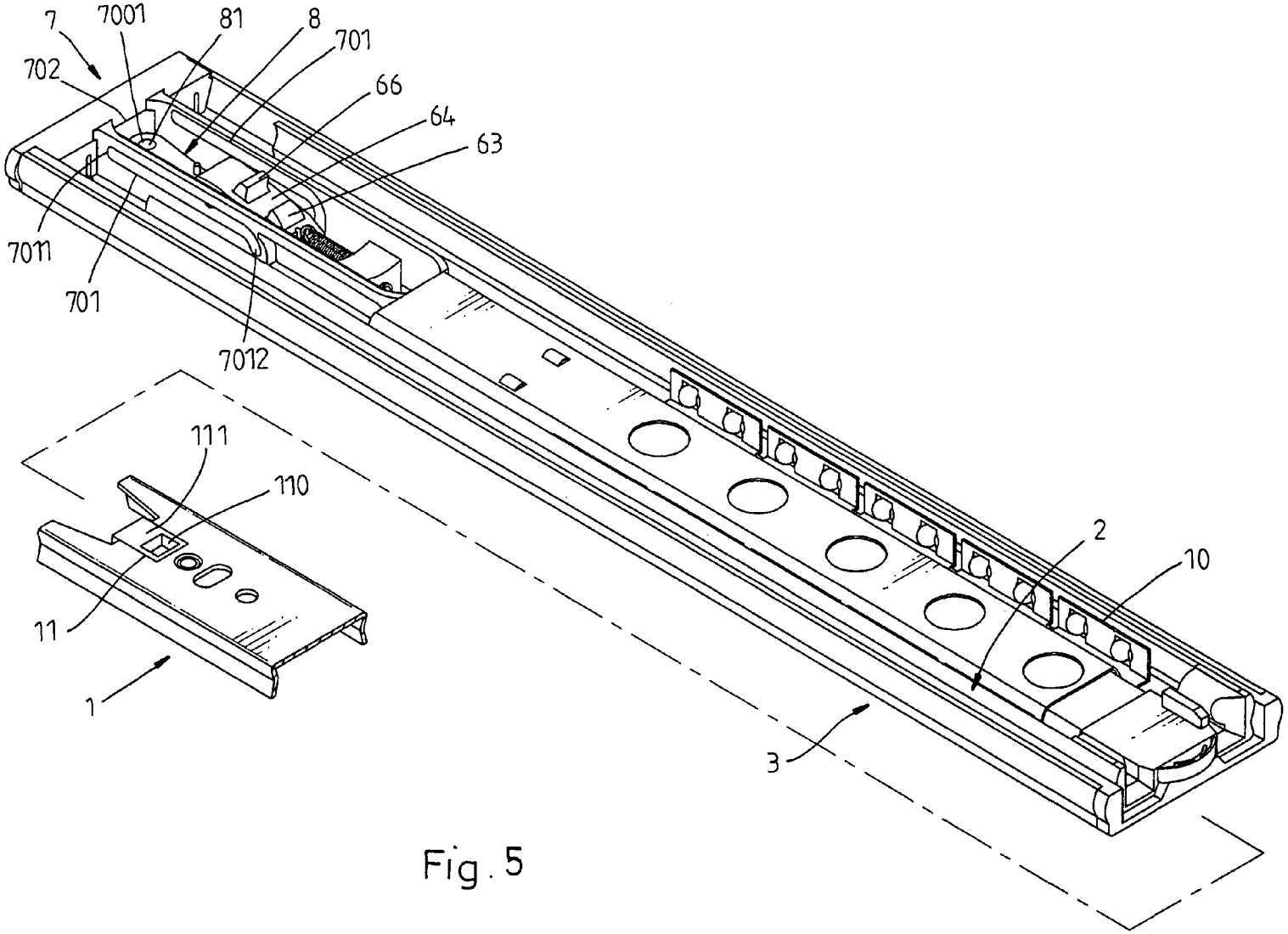
FIG. 5 is schematic exploded view showing the sliding rail assembly auto opening mechanism installed in a sliding rail assembly according to the present invention.
Figure 6:
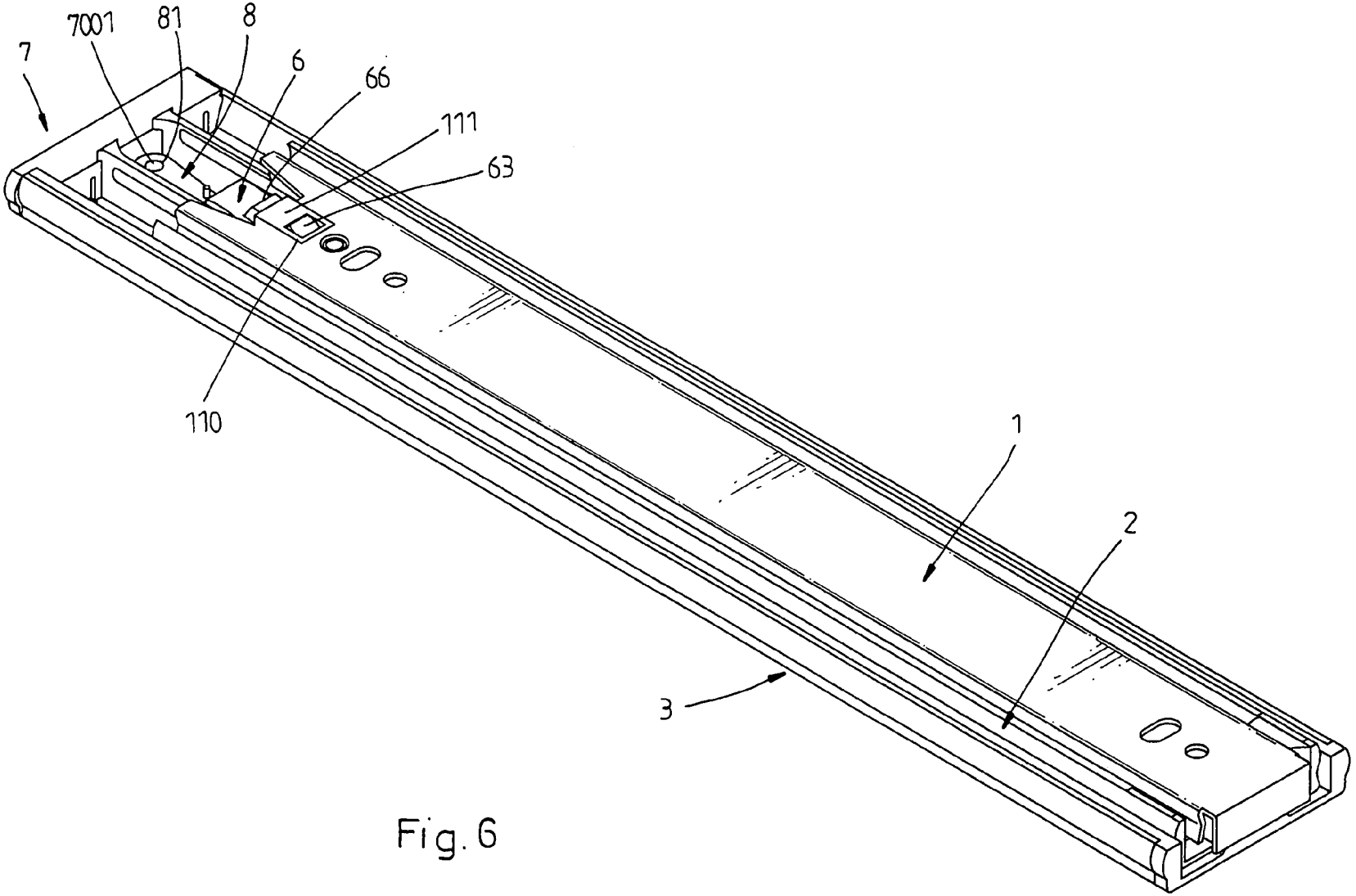
FIG. 6 is an assembly view of FIG. 5.
Figure 7:
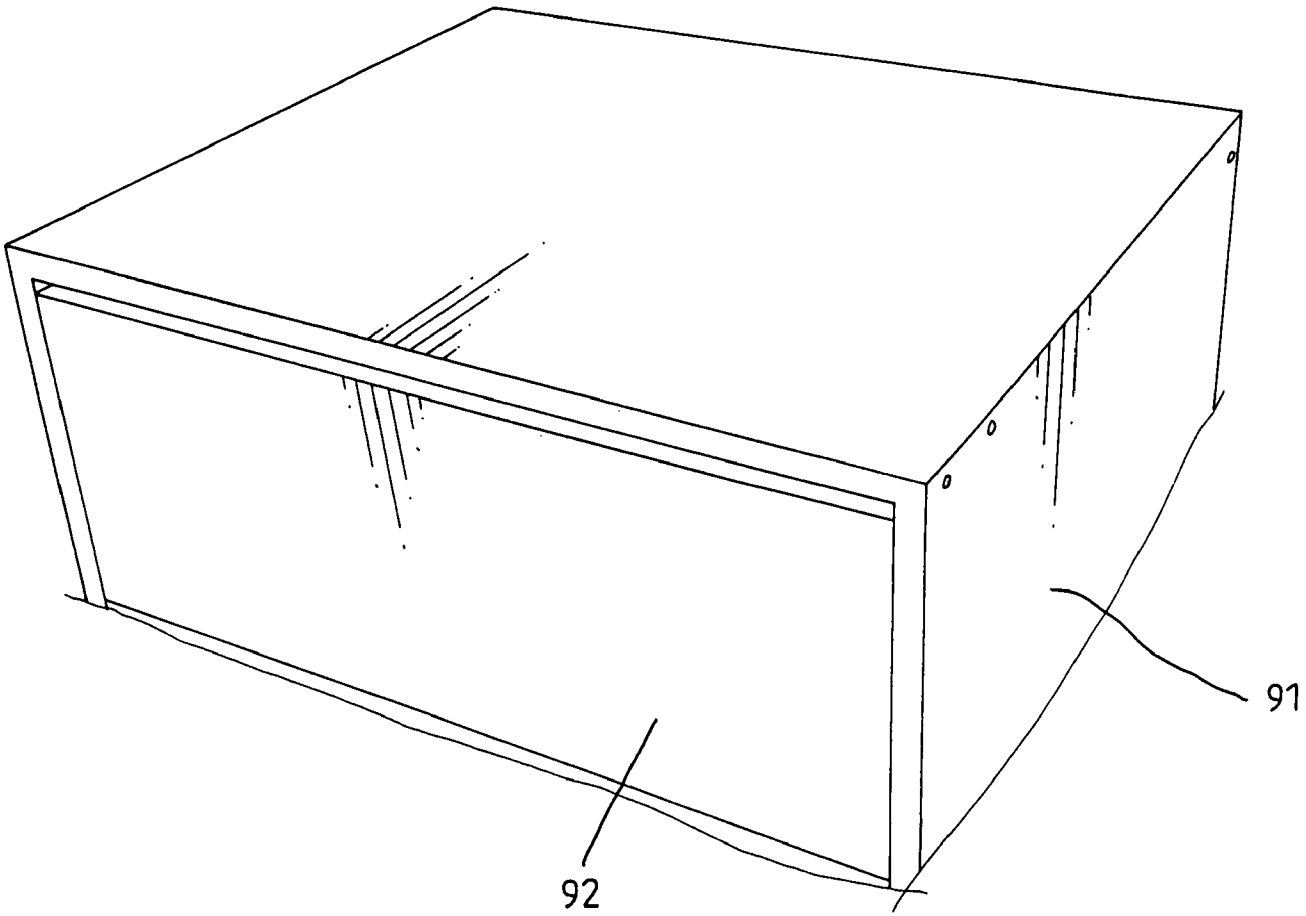
FIG. 7 is a schematic drawing showing a drawer installed in a desk according to the present invention.
Figure 8:
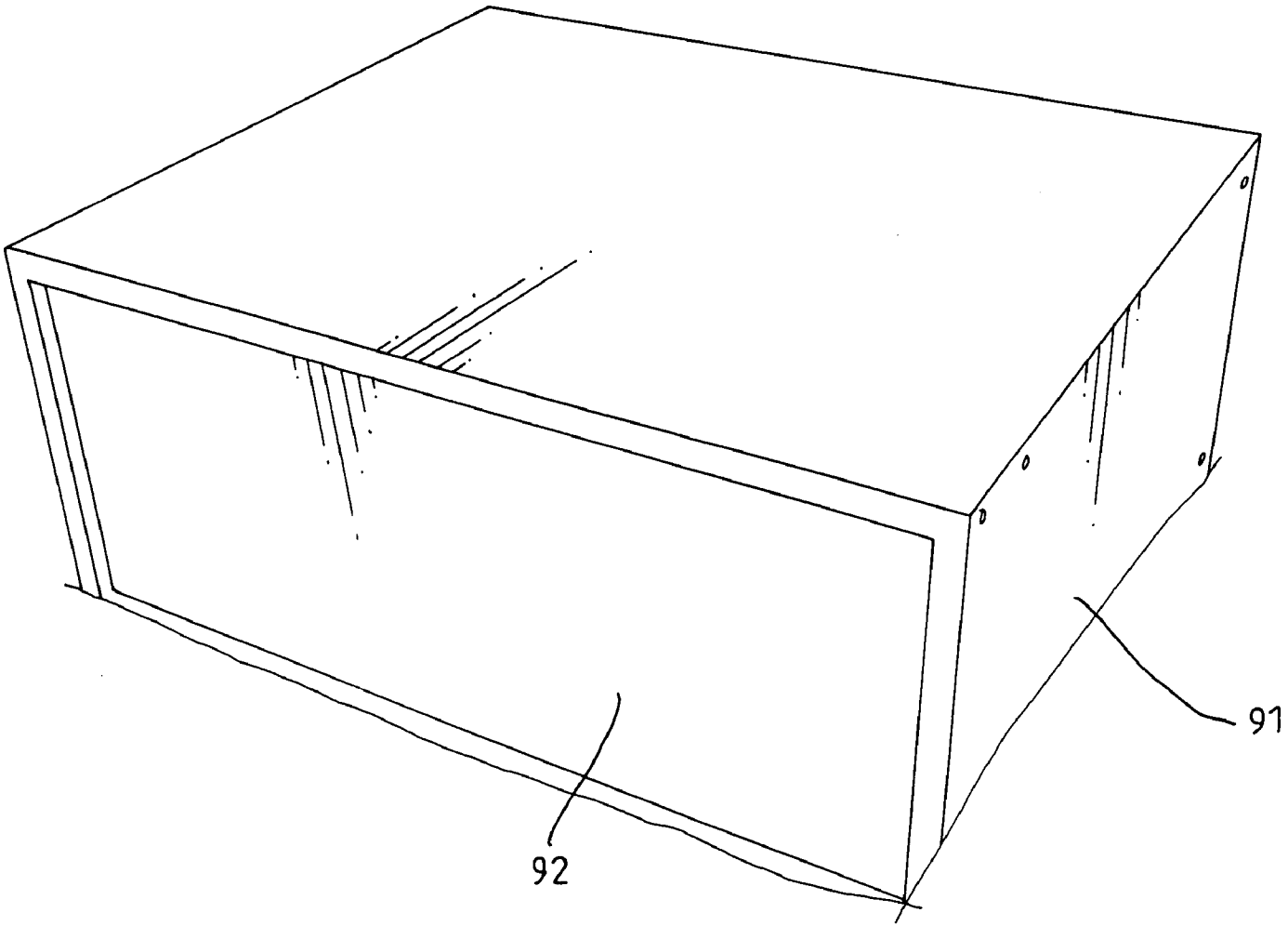
FIG. 8 corresponds to FIG. 7, showing the drawer pushed backwards in the desk.

Referring to FIGS. 1~23, a sliding rail assembly auto opening mechanism is used in a sliding rail assembly for drawer. According to the present preferred embodiment, the sliding rail assembly comprises an outer rail 3, an intermediate sliding rail 2 axially movably mounted in the outer rail 3, an inner sliding rail 1 axially movably mounted in the intermediate sliding rail 2, a first bushing 10 set between the inner sliding rail 1 and the intermediate sliding rail 2, and a second bushing (not shown) set between the intermediate sliding rail 2 and the outer rail 3. The outer rail 3 is fixedly mounted on the inside wall of a desk 91 at a suitable location. The inner sliding rail 1 is fixedly fastened to one side panel of a drawer 92 receivable in the desk 91. By means of the sliding rail assembly, the drawer 92 is movable in and out of the desk 91.

The sliding rail assembly auto opening mechanism comprises a sliding hook 6, a holder block 7, a rocker 8, a spring member 60, and an actuating member 11.

The holder block 7 (see FIGS. 1 and 2) is affixed to the outer rail 3 of the sliding rail assembly, comprising a longitudinal sliding track 70 extending in direction corresponding to the moving direction of the drawer 92, two longitudinal sliding slots 701 symmetrically formed in the longitudinal sliding track 70 at two opposite lateral sides, each longitudinal sliding slot 701 having a rear end terminating in a rear stop edge 7011 and a front end curved forwardly downwards and forming a retaining groove 7012 (see FIG. 11), a locating notch 7013 disposed in the longitudinal sliding track 70 on the middle near the front side, and a stop face 702 disposed at the rear side of the longitudinal sliding track 70 adjacent to the rear stop edge 7011 of each of the longitudinal sliding slots 701, and a pivot 7001 perpendicularly extending from the bottom wall 700 of the track 70.

The rocker 8 (see FIGS. 1, 2 and 14) has a rear coupling hole 81 pivotally coupled to the pivot 7001 of the holder block 7, and a front locating rod 82 facing the rear side of the sliding hook 6.

The sliding hook 6 (see FIGS. 1, 3 and 13) comprises two front guide rods 61 and two rear guide rods 62 respectively coupling to the longitudinal sliding slots 701 of the holder block 7 to guide forward/backward movement of the sliding hook 6 along the longitudinal sliding track 70, a front sloping guide face 63 raised from the top wall near the front side, a rear stop block 66 protruded from the top wall near the rear side, a locating groove 64 transversely formed in the top wall on the middle between the front sloping guide face 63 and the rear stop block 66, a locating hole 65 situated at the front side, a guide-in groove 671 formed in the bottom wall, a retaining groove 672 formed in the bottom wall in communication with one end of the guide-in groove 671, a guide-out groove 674 formed in the bottom wall, a sliding groove 673 formed in the bottom wall and connected between the retaining groove 672 and the guide-out groove 674, a sloping block 675 protruded from the bottom wall for guiding the locating rod 82 of the rocker 8 into the guide-in groove 671, and a front open groove 676 disposed at the front side of the sloping block 675. The guide-in groove 671 comprises an entrance 6711, a curved groove portion 6712, and a guiding groove portion 6713.

The spring member 60 has a rear end 601 fastened to the locating hole 65 of the sliding hook 6, and a front end 602 fastened to the locating notch 7013 of the holder block 7.

The actuating member 11 (see FIGS. 5, 11 and 14) is fixedly connected to the front side of the inner sliding rail 1, having a hole 110 and an actuating rod 111.

Figure 9:
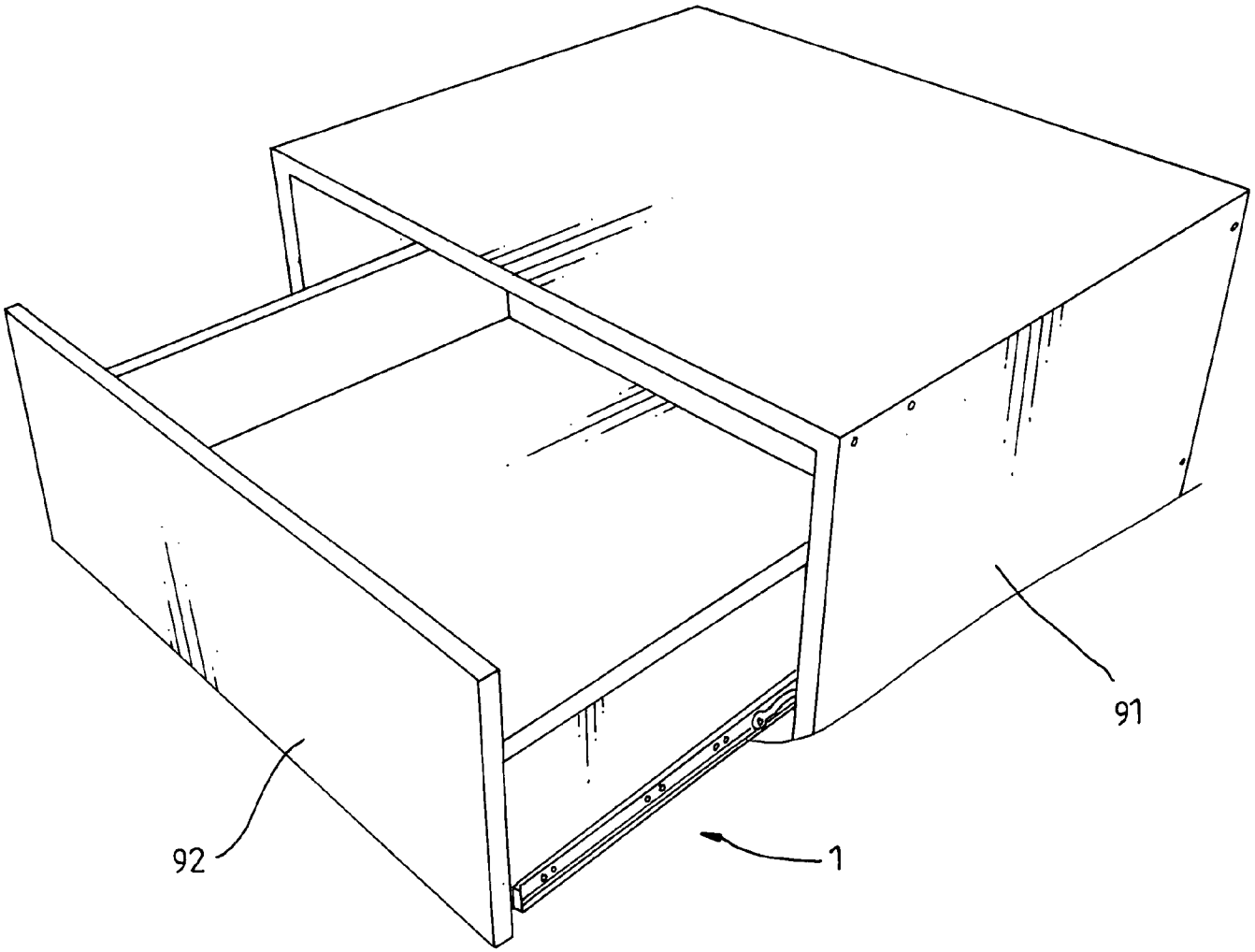
FIG. 9 corresponds to FIG. 8, showing the drawer extended out of the desk.
Figure 10:
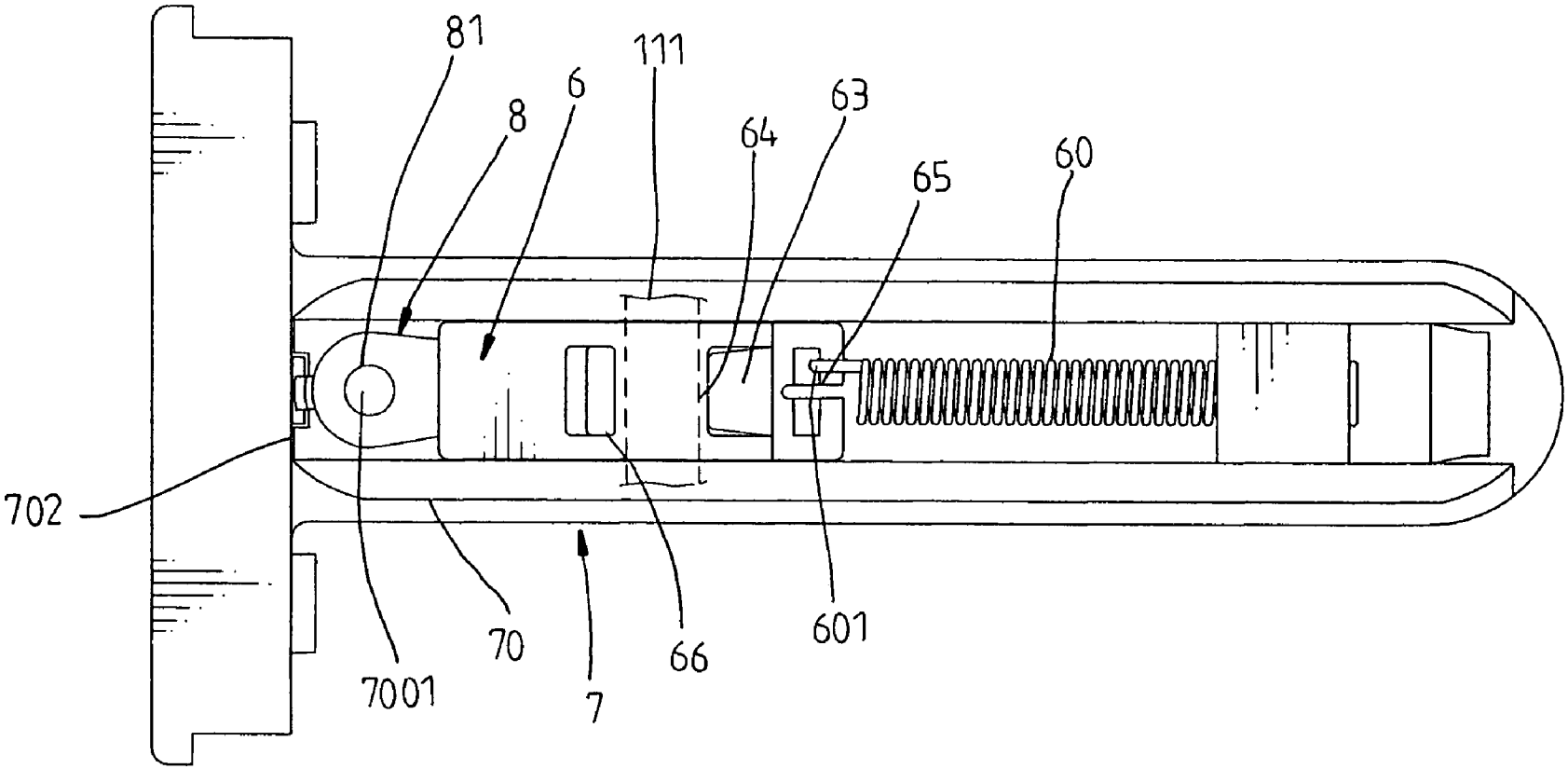
FIG. 10 is a top plain view of the present invention, showing the sliding hook engaged with the actuating member.
Figure 11:
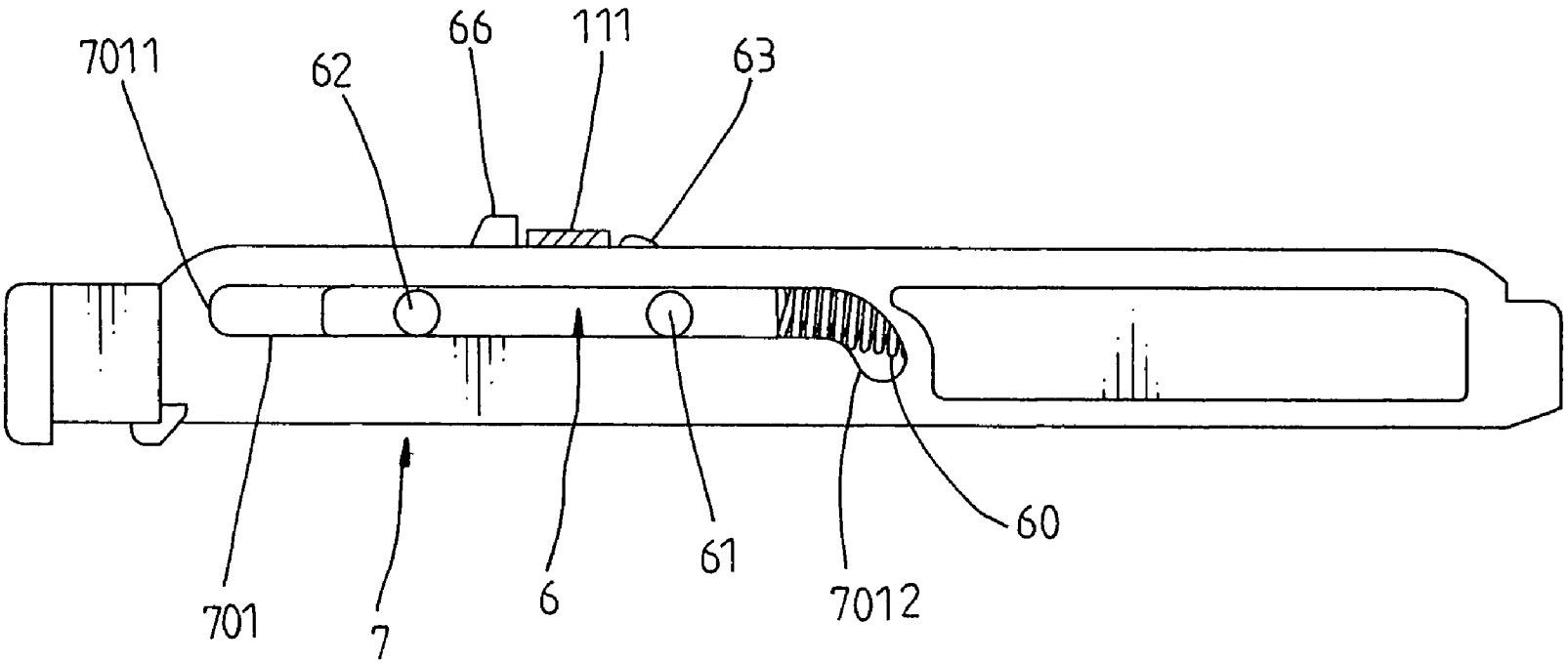
FIG. 11 is a side plain view of FIG. 10.
Figure 12:
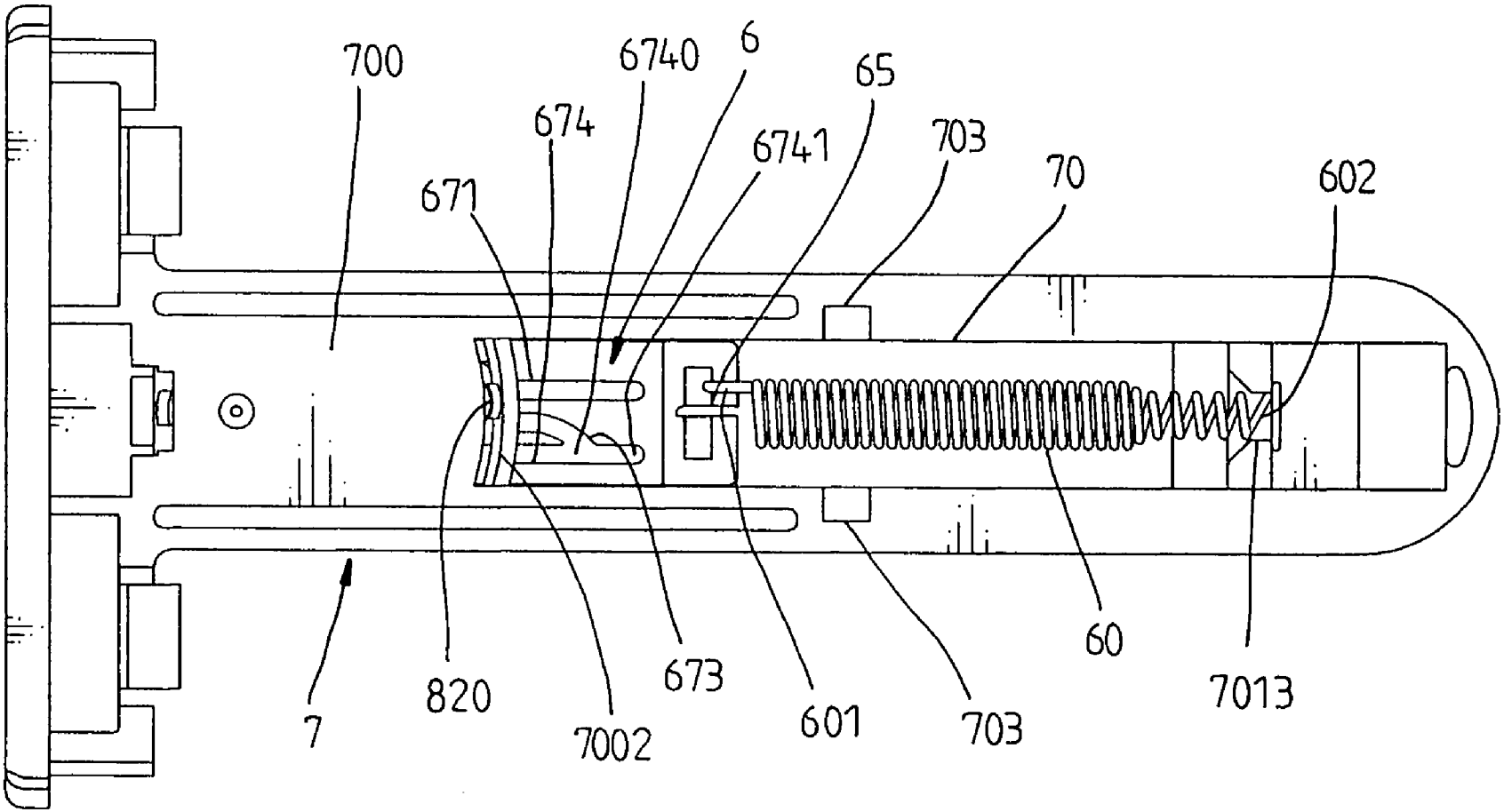
FIG. 12 is a bottom plain view of FIG. 10.
Figure 13:
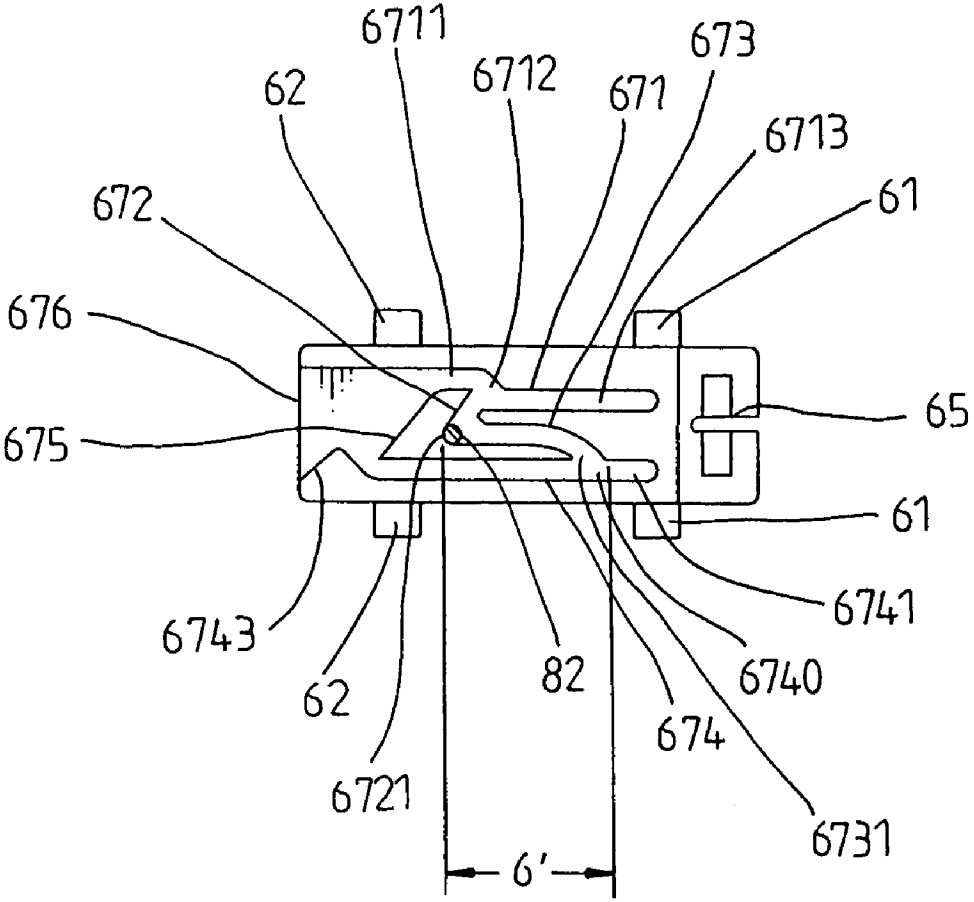
FIG. 13 is a schematic bottom plain view of a part of the present invention, showing the front locating rod of the rocker engaged into the retaining portion of the retaining groove of the sliding hook.
Figure 14:
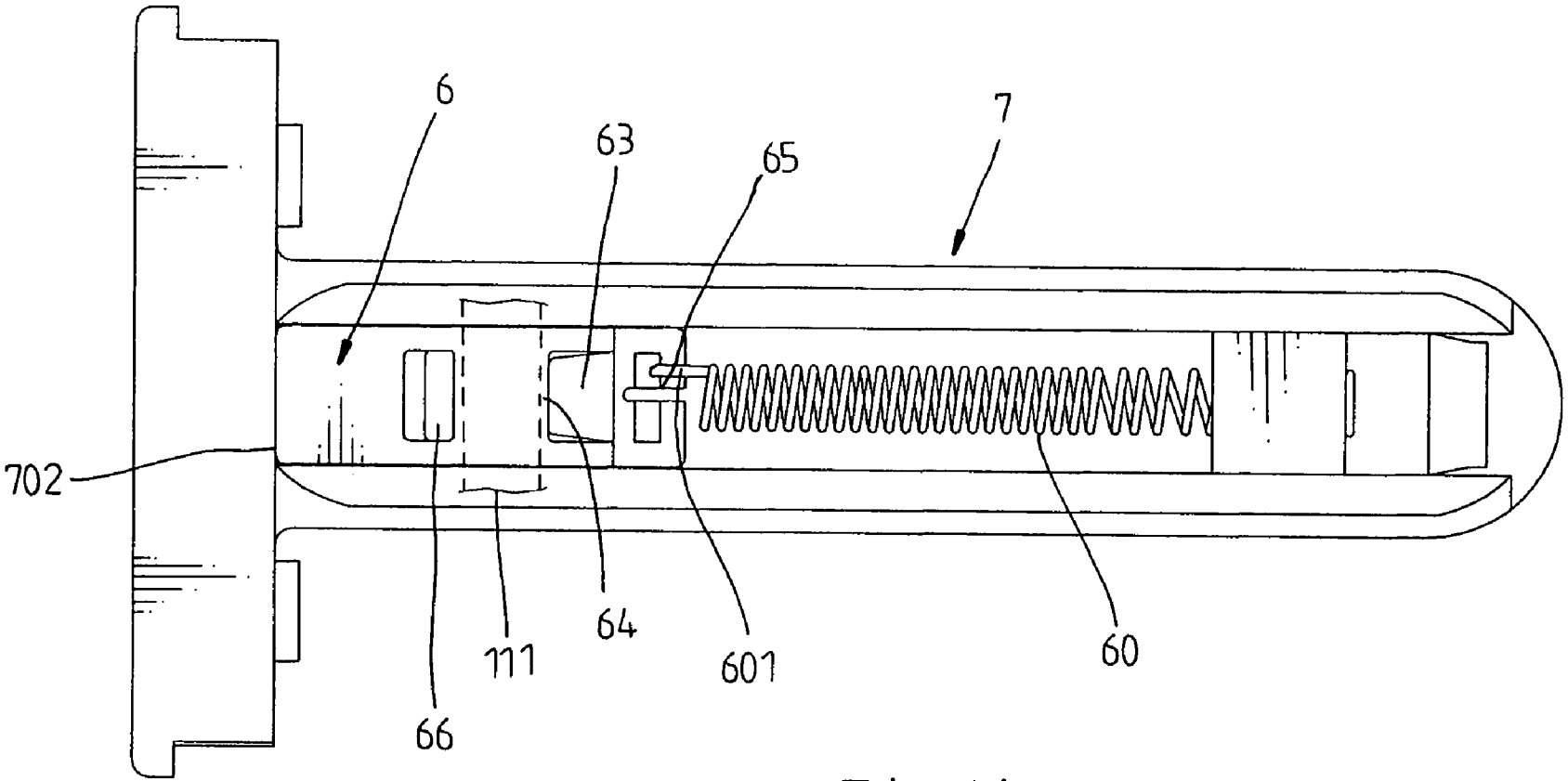
FIG. 14 is a bottom plain view of the present invention, showing the sliding hook moved to the rear side of the longitudinal sliding track of the holder block.
Figure 15:
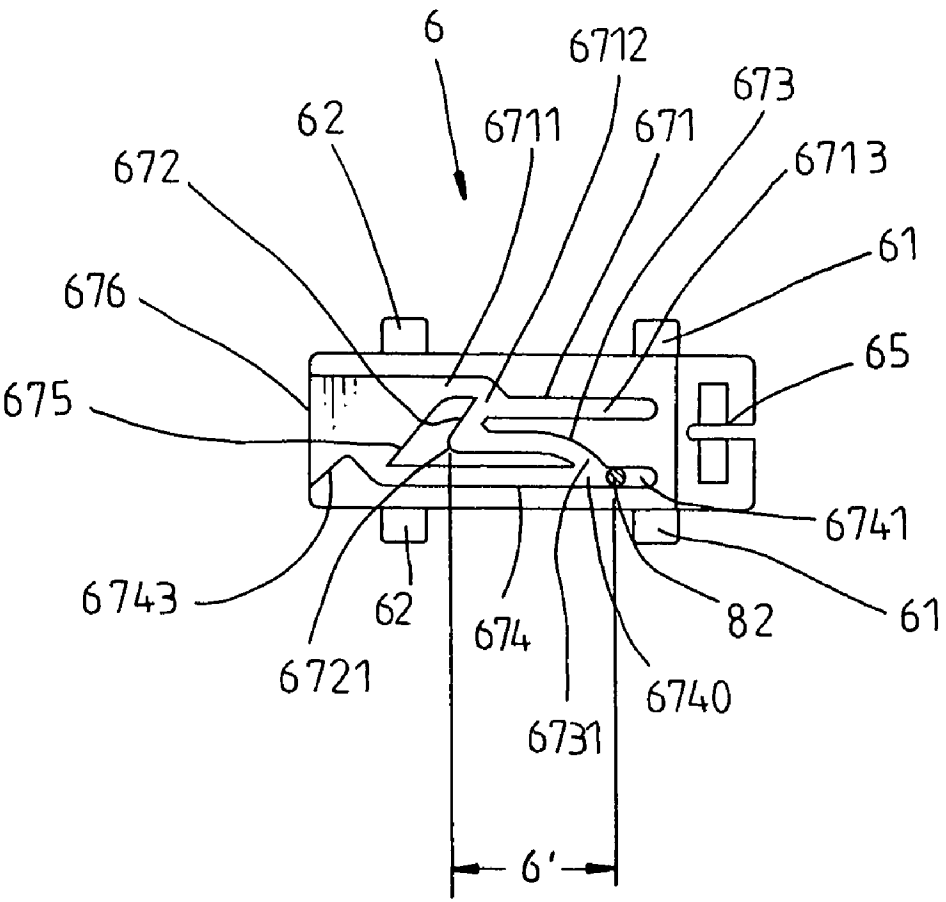
FIG. 15 is a schematic bottom plain view of a part of the present invention, showing the front locating rod of the rocker moved to the rear side of the guide-out groove.
Figure 16:
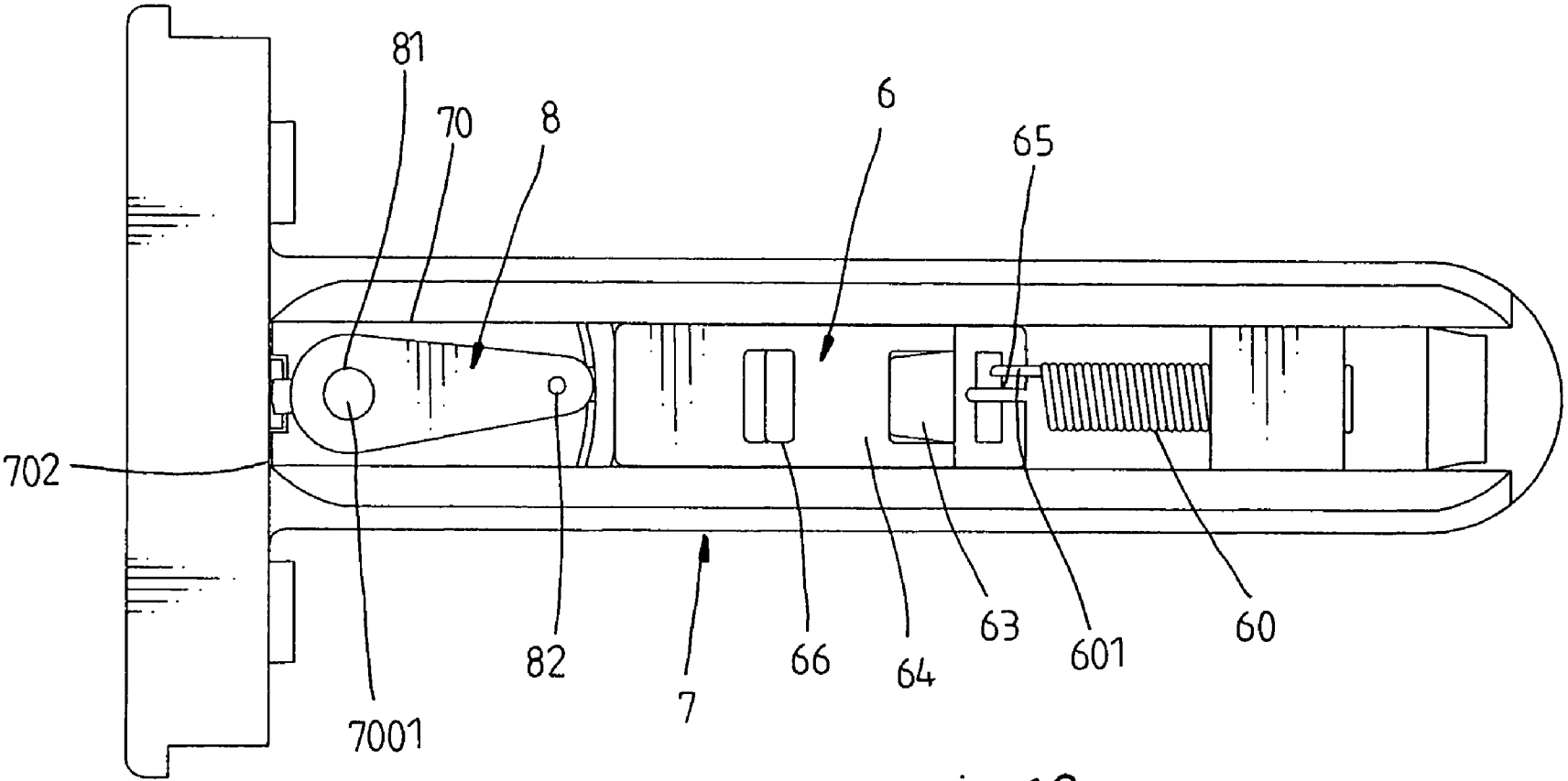
FIG. 16 is a schematic top plain view of the present invention, showing the sliding hook returned to the front side of the longitudinal sliding track of the holder block.
Figure 17:
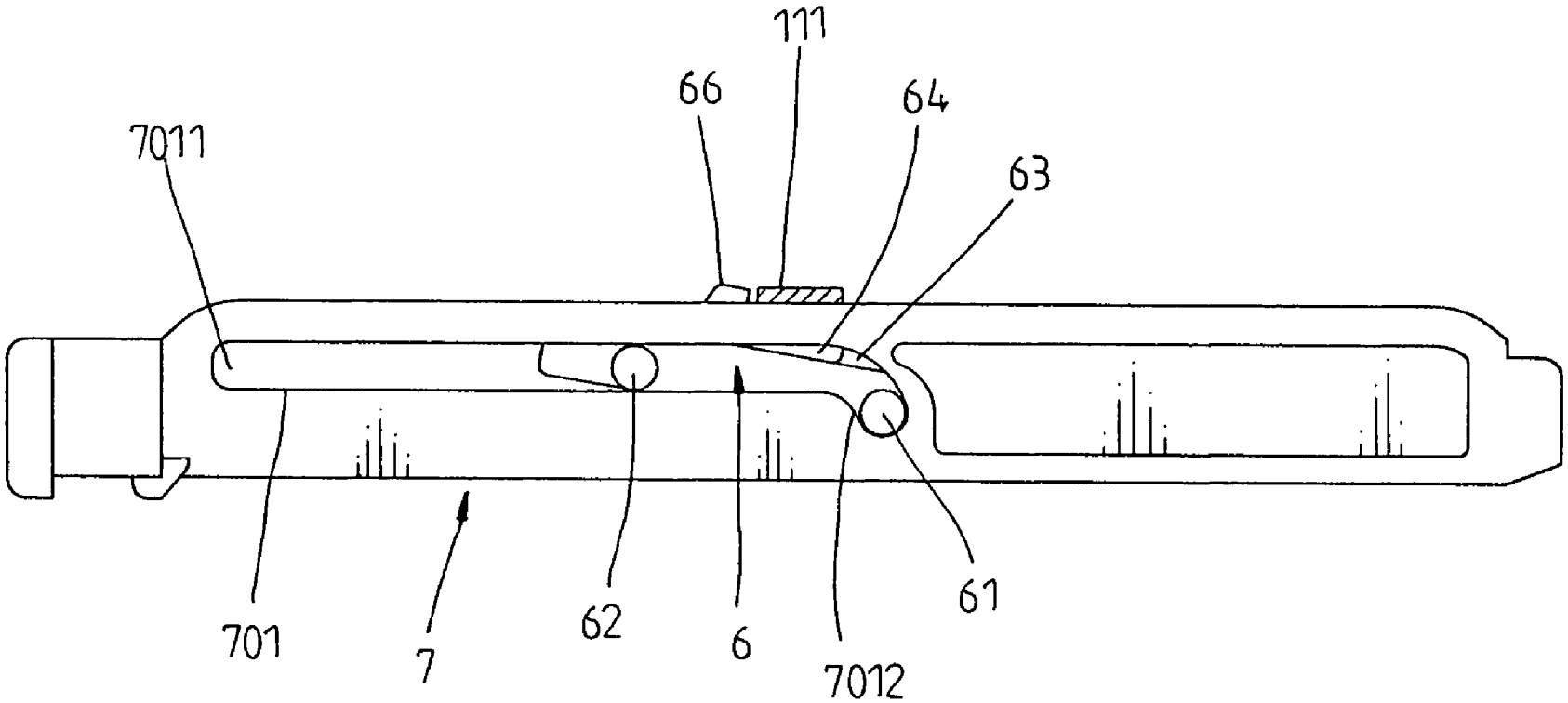
FIG. 17 is a schematic side plain view of FIG. 6.
Figure 18:
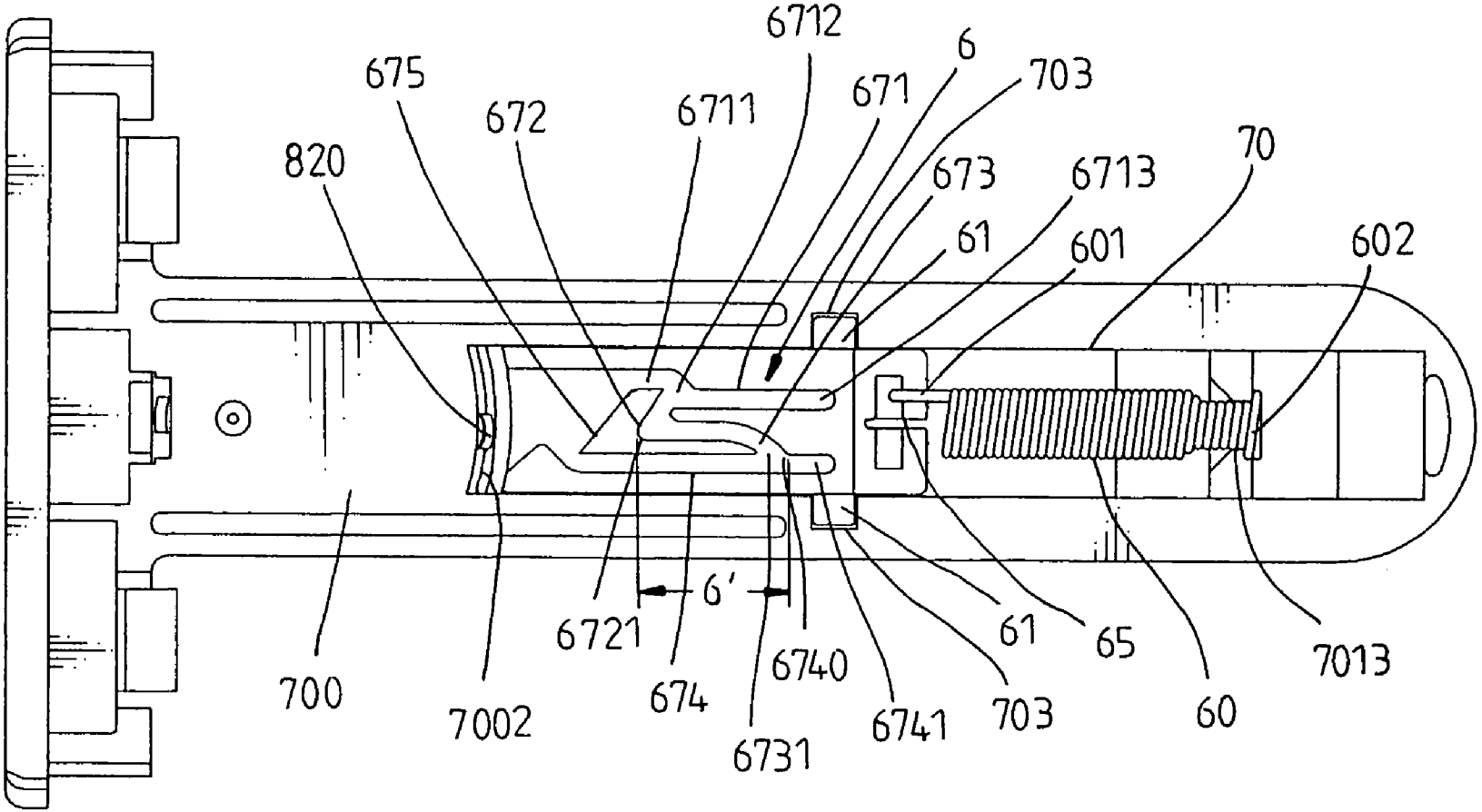
FIG. 18 is a schematic bottom plain view of FIG. 16.
Figure 19:
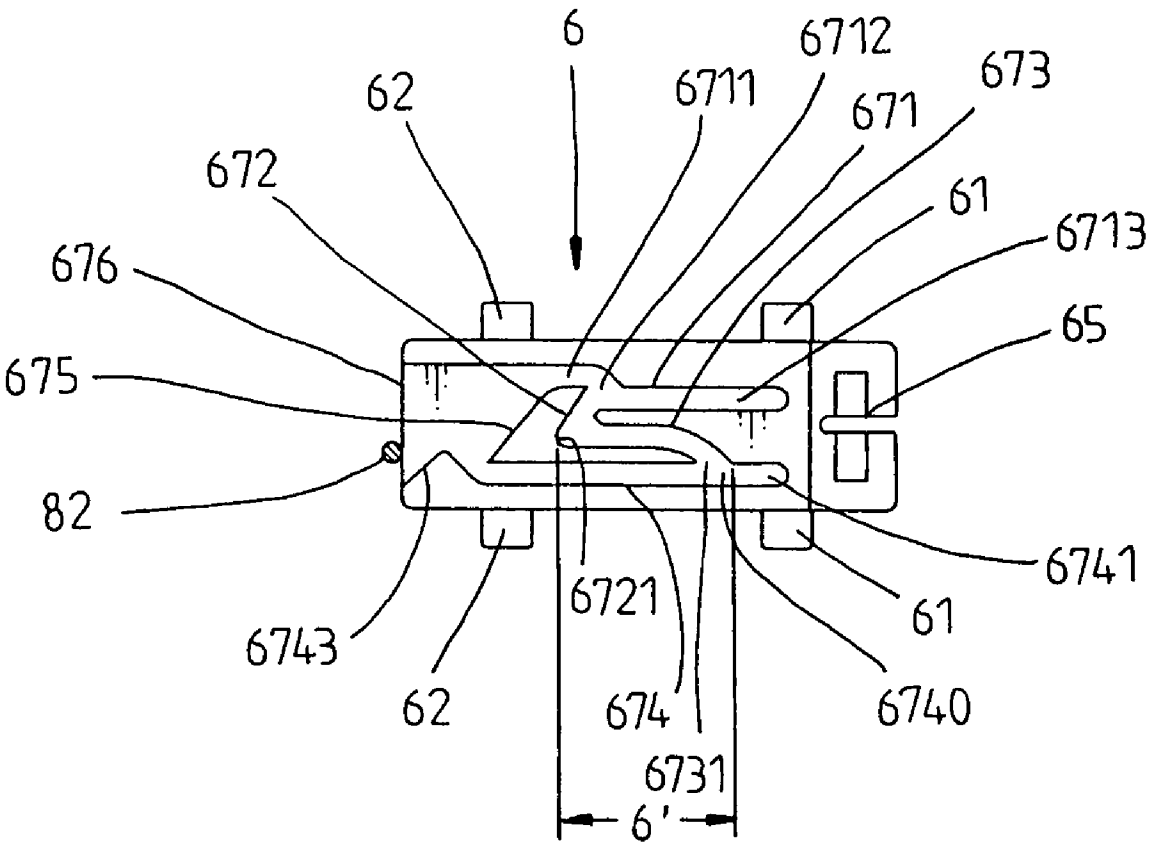
FIG. 19 is a schematic bottom plain view of a part of the present invention, showing the front locating rod of the rocker moved to the front open groove of the sliding hook.
Figure 20:
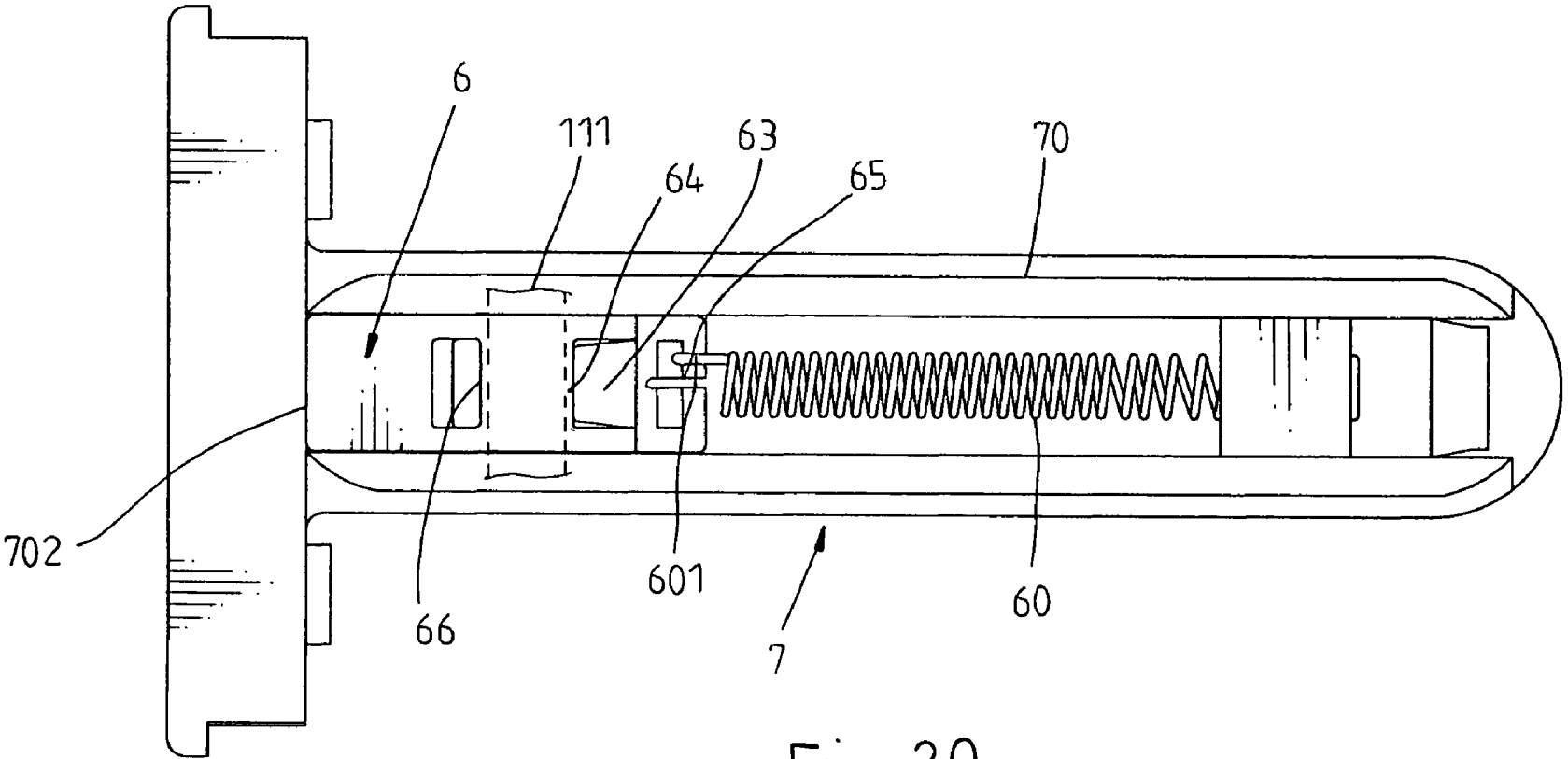
FIG. 20 is a schematic top plain view of the present invention, showing the sliding hook stopped at the stop face at the rear side of the longitudinal sliding track of the holder block.
Figure 21:
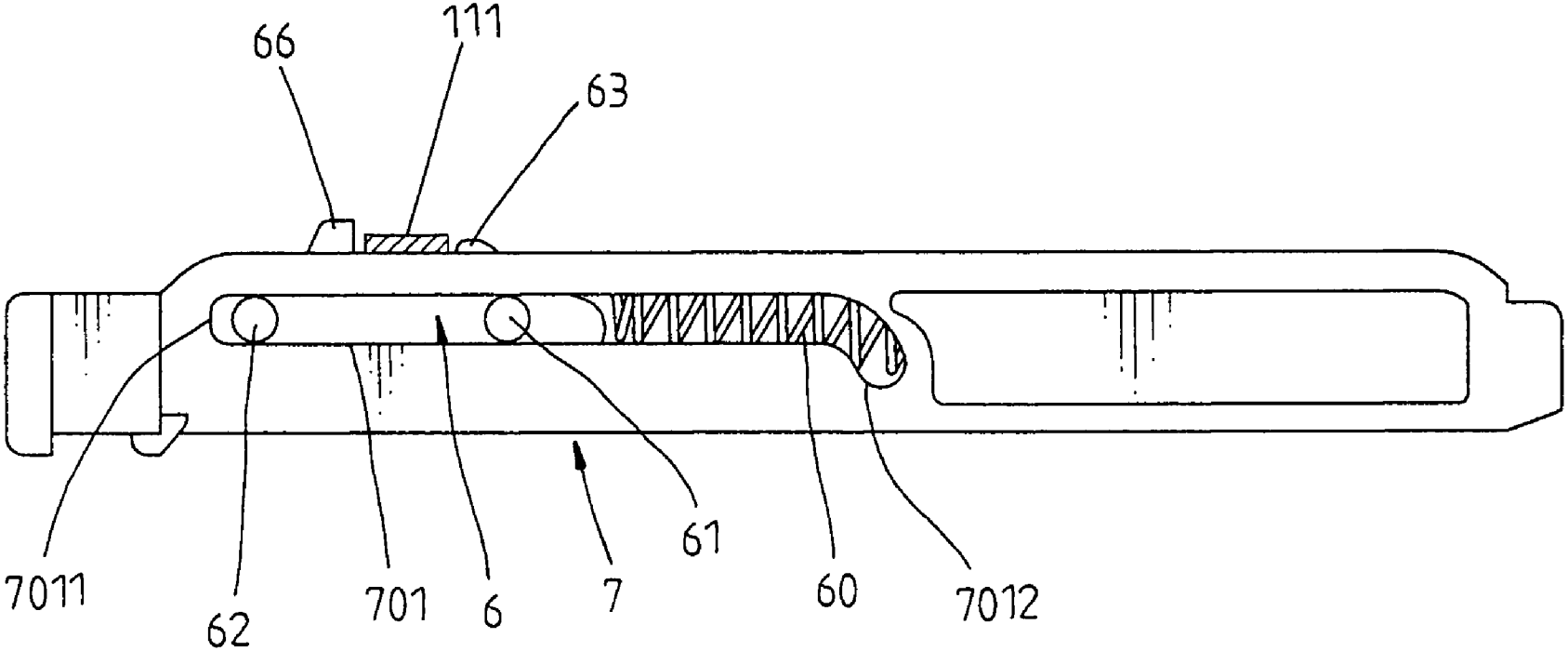
FIG. 21 is a schematic side plain view of FIG. 20.
Figure 22:
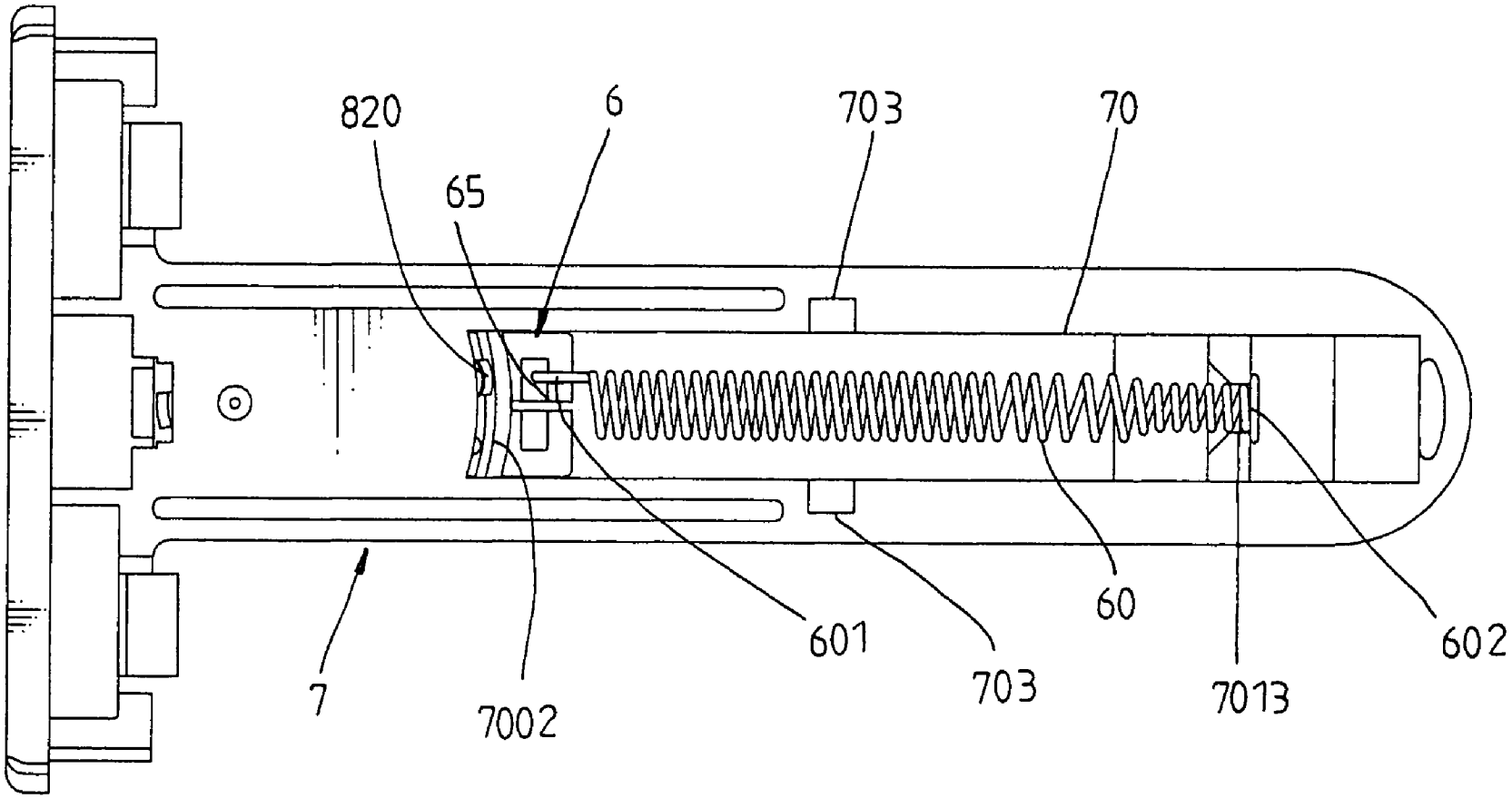
FIG. 22 is a schematic top plain view of FIG. 20.
Figure 23:
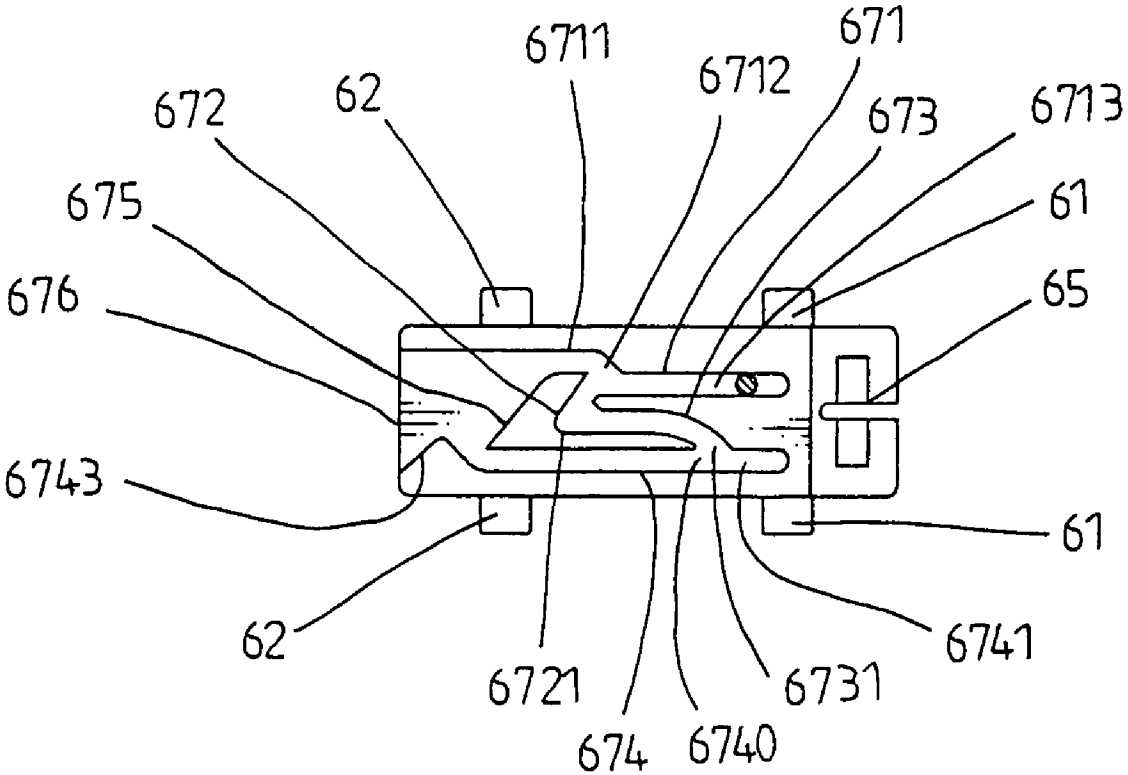
FIG. 23 is a schematic bottom plain view of a part of the present invention, showing the front locating rod of the rocker moved to the guiding groove portion of the guide-in groove of the sliding hook.

When the sliding rail assembly is in the received position, i.e., when the drawer 92 is received inside the desk 91 (see FIG. 7), the actuating rod 111 of the actuating member 11 is positioned in the locating groove 64 of the sliding hook 6, the front guide rods 61 and rear guide rods 62 of the sliding hook 6 are kept in the sliding slots 701 of the holder block 7 on the middle (see FIG. 11), and the front locating rod 82 of the rocker 8 is engaged in the retaining portion 6721 of the retaining groove 672 of the sliding hook 6 (see FIG. 13). When the drawer 92 is pushed backwards (see FIG. 8), the actuating rod 111 of the actuating member 11 is forced against the rear stop block 66 of the sliding hook 6 to push the sliding hook 6 backwards along the longitudinal sliding slots 701 and to stretch the spring member 60. At this time, the front locating rod 82 of the rocker 8 is forced away from the retaining portion 6721 of the retaining groove 672 into the sliding groove 673 and then the guide-out groove 674 to the rear side 6741 of the guide-out groove 674 by the actuating rod 111 of the actuating member 11 (see FIG. 15). When the front locating rod 82 of the rocker 8 reached the rear side 6741 of the guide-out groove 674, the spring member 60 immediately pulls the sliding hook 6 toward the front side of the holder block 7, thereby causing the front guide rods 61 of the sliding hook 6 to be engaged into the retaining grooves 7012 of the holder block 7 (see FIGS. 16 and 17), and therefore the actuating rod 111 of the actuating member 11 is released from the constraint of the locating groove 64 to open (unlock) the sliding rail assembly (FIG. 9 shows an open status of the drawer 92). When the spring member 60 pulls the sliding hook 6 forwards, guide-out groove 674 guides the front locating rod 82 of the rocker 8 to the front side of the front open groove 676 (see FIG. 19). When the user pushed the drawer 92 backwards into the inside of the desk 91, the actuating rod 111 of the actuating member 11 is forced against the rear stop block 66 of the sliding hook 6 to move the sliding hook 6 backwards along the longitudinal sliding slots 701 and to further stretch the spring member 60. When the sliding hook 6 reached the stop face 702 of the holder block 7 (see FIGS. 20 and 21), the front locating rod 82 of the rocker 8 is moved through the entrance 6711 and the curved groove portion 6712 into the guiding groove portion 6713 (see FIGS. 22 and 23). When the front locating rod 82 reached the rear side of the guiding groove portion 6713, the returning force of the spring member 60 pulls the sliding hook 6 backwards, thereby causing the front locating rod 82 of the rocker 8 to be guided by the guiding groove portion 6713 into the retaining portion 6721 of the retaining groove 672 to lock the sliding hook 6 (see FIGS. 10-13), and therefore the drawer 92 is locked in the received position for a next opening action upon a pressure.

The sliding hook 6 comprises a guide block 6743 facing the rear side of the guide-out groove 674 (see FIGS. 3 and 13) for guiding the front locating rod 82 of the rocker 8 out of the guide-out groove 674 toward the sloping block 675.

Further, the sliding groove 673 has a rear side disposed in communication with one side of the retaining groove 672 that slopes in one direction, and a curved front side disposed in communication with a front part 6740 of the guide-out groove 674.

Further, the holder block 7 has two guide grooves 703 bilaterally formed in the longitudinal siding track 70 in communication with the retaining grooves 7012 of the longitudinal sliding slots 701 for easy insertion of the guide rods 61, 62 of the sliding hook 6 into the longitudinal sliding slots 701 of the holder block 7 during installation.

Further, the rocker 8 has a front arched block 820 coupled to a sliding groove 7002 in the bottom wall 700 of the track 70 to guide movement of the rocker 8 about the pivot 7001 smoothly.

As indicated above, the sliding rail assembly auto opening mechanism has the following advantages:

1. The holder block 7 which is affixed to the outer rail 3 of the sliding rail assembly inside the desk 91 provides two parallel sliding slots 701 to guide movement of the sliding hook 6; the actuating member 11 which is affixed to the inner sliding rail 1 at the drawer 92 works with the spring member 60 to control the action of the sliding hook 6; the rocker 8 which is pivoted to the pivot 7001 in the holder block 7 has a front locating rod 82 movable in and out of the guide-in groove 671, retaining groove 672, sliding groove 673 and guide-out groove 674 of the holder block 7. By means of the aforesaid arrangement, the drawer 92 can be automatically opened when pressed, and then returned to the locked status when received in the desk 91.
2. The distance 6' between the retaining portion 6721 of the retaining groove 672 and the front side 6731 of the sliding groove 673 ensures that the drawer 92 can be unlocked and opened only when the sliding hook 6 has been moved forwards over the distance 6' to have the front locating rod 82 be moved away from the retaining portion 6721 through the sliding groove 673 into the guide-out groove 674. Therefore, the user must push the drawer 92 backwards over the distance 6' to unlock the sliding rail assembly. This design prevents a false action of the sliding rail assembly when a child touches the drawer 92 accidentally.
3. Because the parts of the sliding rail assembly auto opening mechanism are mounted in the sliding rail assembly, the sliding rail assembly auto opening mechanism does not occupy an additional inside space of the desk 91, i.e., the invention saves much installation space.
4. Because the sliding rail assembly auto opening mechanism is provided between one side panel of the drawer 92 and an inside wall of the desk 91, the sliding rail assembly is automatically opened (unlocked) when the face panel of the drawer 92 is moved inwards over the distance 6' (see FIGS. 13, 15, 18 and 19).

What is claimed is:

1. A sliding rail assembly auto opening mechanism used in a sliding rail assembly, said sliding rail assembly comprising an outer rail fixedly mounted on the inside wall of a desk, an intermediate sliding rail axially movably mounted in said outer rail, an inner sliding rail axially movably mounted in said intermediate sliding rail and affixed to one side panel of a drawer receivable in said desk, a first bushing set between said inner sliding rail and said intermediate sliding rail, and a second bushing set between said intermediate sliding rail and said outer rail, said sliding rail assembly auto opening mechanism comprising:

a holder block affixed to the outer rail of said sliding rail assembly, said holder block comprising a longitudinal sliding track extending in direction corresponding to the moving direction of said drawer, two longitudinal sliding slots symmetrically formed in said longitudinal sliding track at two opposite lateral sides, said longitudinal sliding slots each having a rear end terminating in a rear stop edge and a front end curved forwardly downwards and forming a retaining groove, a locating notch disposed in said longitudinal sliding track on the middle near a front side of said longitudinal sliding track, and a stop face disposed at a rear side of said longitudinal sliding track adjacent to the rear stop edge of each of said longitudinal sliding slots, and a pivot perpendicularly extending from a bottom wall of said longitudinal sliding track;

a rocker, said rocker having a rear coupling hole pivotally coupled to the pivot of said holder block and a front locating rod;

a sliding hook, said sliding hook comprising a top wall, a bottom wall, two front guide rods and two rear guide rods respectively coupling to the longitudinal sliding slots of said holder block to guide forward/backward movement of said sliding hook along said longitudinal sliding track, a front sloping guide face raised from the top wall near a front side thereof, a rear stop block protruded from the top wall near a rear side thereof, a locating groove transversely formed in the top wall on the middle between said front sloping guide face and said rear stop block, a locating hole situated at the front side, a guide-in groove formed in the bottom wall, a retaining groove formed in the bottom wall in communication with said guide-in groove, a guide-out groove formed in the bottom wall, a sliding groove formed in the bottom wall and connected between said retaining groove and said guide-out groove, a sloping block protruded from the bottom wall for guiding the locating rod of said rocker into said guide-in groove, and a front open groove disposed at a front side of said sloping block, said guide-in groove comprising an entrance, a curved groove portion, and a guiding groove portion; said curved groove portion being in communication with one side of said retaining groove;

a spring member connected between the locating hole of said sliding hook and the locating notch of said holder block; and a actuating member fixedly connected to the front side of the inner sliding rail of said sliding rail assembly, said actuating member having an actuating rod.

2. The sliding rail assembly auto opening mechanism as claimed in claim 1, wherein said sliding hook comprises a guide block facing a rear side of said guide-out groove for guiding the front locating rod of said rocker out of said guide-out groove toward said sloping block.

3. The sliding rail assembly auto opening mechanism as claimed in claim 1, wherein the sliding groove of said sliding hook has a rear side disposed in communication with one side of the retaining groove of said sliding hook that slopes in one direction, and a curved front side disposed in communication with a front part of said guide-out groove.

4. The sliding rail assembly auto opening mechanism as claimed in claim 1, wherein said holder block has two guide grooves bilaterally formed in said longitudinal siding track in communication with the retaining grooves of said longitudinal sliding slots for easy insertion of the guide rods of said sliding hook into the longitudinal sliding slots of said holder block during installation.

5. The sliding rail assembly auto opening mechanism as claimed in claim 1, wherein said rocker has a front arched block coupled to a sliding groove in the bottom wall of said longitudinal sliding track of said holder block to guide movement of said rocker about the pivot of said holder block.

* * * * *